US006418896B2

(12) United States Patent
Ogawa

(10) Patent No.: US 6,418,896 B2
(45) Date of Patent: Jul. 16, 2002

(54) VARIABLE VALVE TIMING SYSTEM

(75) Inventor: Kazumi Ogawa, Toyota (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 0 days.

(21) Appl. No.: 09/847,281

(22) Filed: May 3, 2001

(30) Foreign Application Priority Data

May 10, 2000 (JP) ..... 2000-137694

(51) Int. Cl.[7] ..... F01L 1/34

(52) U.S. Cl. ..... 123/90.17; 123/90.15; 74/568 R

(58) Field of Search ..... 123/90.12, 90.15, 123/90.17, 90.31; 74/568 R; 464/1, 2, 160

(56) References Cited

U.S. PATENT DOCUMENTS 5,870,983 A * 2/1999 Sato ..... 123/90.17
5,875,750 A * 3/1999 Iwasaki ..... 123/90.17
6,062,182 A * 5/2000 Ogawa ..... 123/90.17

* cited by examiner

*Primary Examiner*—Thomas Denion
*Assistant Examiner*—Jaime Corrigan

(57) ABSTRACT

A variable valve timing system have a rotor member relatively rotatably mounted into a housing member and forming an advanced angle chamber and a retarded angle chamber at a vane portion in the housing member. In the system, a lock member of a lock mechanism is not caught between the rotor member and the housing member when a volume of either the advanced angle chamber or the retarded angle chamber shifts from an initial volume to a target volume. The hydraulic pressure within the system is shifted from an initial condition in which the volume is maintained at the initial volume and locked by the lock mechanism, to another condition in which the volume is varied to the target volume after passing a transition in which the volume is maintained at the initial volume and the lock mechanism is being unlocked during a predetermined time.

14 Claims, 7 Drawing Sheets

VARIABLE VALVE TIMING SYSTEM

This application is based on and claims under 35 U. S. C. §119 with respect to Japanese Patent Application No. 2000-137694 filed on May 10, 2000, the entire content of which is incorporated herein by reference.

FIELD OF THE INVENTION

This invention generally relates to variable valve timing systems. More particularly, the present invention pertains to a variable valve timing system for controlling the opening and closing time of an intake valve and an exhaust valve of a vehicle engine.

BACKGROUND OF THE INVENTION

Known variable valve timing system is described in Japanese Patent Laid-Open Publication No. H09-264110. The disclosed variable valve timing system includes a housing member disposed in the driving force transmitting system for transmitting the driving force from a crankshaft of a combustion engine to a camshaft for controlling the opening and closing of either an intake valve or an exhaust valve of the combustion engine. The housing member rotates in one unit with either the crankshaft or the camshaft. The variable valve timing system further includes a rotor member rotatably mounted to a shoe portion provided on the housing member. The rotor member forms an advanced angle chamber and a retarded angle chamber at a vane portion in the housing member and integrally rotates with either the camshaft or the crankshaft. The aforementioned known variable valve timing system further includes a torsion spring for rotatably biasing the rotor member relative to the housing member, a stopper mechanism for defining the initial phase of the housing member and the rotor member, a lock mechanism for restricting relative rotation between the housing member and the rotor member at the initial phase, and a hydraulic pressure circuit for controlling supply and discharge of the operation fluid for the advanced angle chamber and the retarded angle chamber as well as for controlling supply and discharge of the operation fluid from the lock mechanism.

With respect to the variable valve timing system disclosed in the prior art, the hydraulic pressure control condition of the hydraulic pressure circuit is promptly switched from the initial hydraulic pressure control condition in which the rotor is maintained at the initial phase so as to lock the relative rotation between the housing member and the rotor member by the lock mechanism a condition in which the lock mechanism is released so as to shift the phase to the target advanced angle value. In the foregoing structure, before the lock mechanism is released by the operation fluid supplied from the hydraulic pressure circuit, the retract movement of the lock mechanism from the locked position to the unlocked position may be disturbed due to the large sliding resistance of a lock member, such as a lock pin, of the lock mechanism which is caught between the rotor member and the housing member accompanying to the relative rotation therebetween by the rotational force of the torsion spring. The lock pin restricts relative rotation between the rotor member and the housing member by engaging with both of them at a locked position and allows relative rotation of the rotor member and the housing member by retracting one of them at the unlocked position.

SUMMARY OF THE INVENTION

In light of the foregoing, the present invention provides a variable valve timing system for advancing and retarding valve timing of intake and exhaust valves of a combustion engine. The variable valve timing system is programmed to control a hydraulic pressure control condition of a hydraulic pressure circuit in the system. The hydraulic pressure control condition is shifted from an initial hydraulic pressure control condition in which a rotor is maintained at an initial phase and locked by a lock mechanism, to a phase shiftable hydraulic pressure control condition in which a volume of either an advanced or retarded angle chamber is varied to reach a target angle via a transitional hydraulic pressure condition in which the rotor is maintained at the initial phase and the lock mechanism is released.

BRIEF DESCRIPTION OF THE DRAWINGS

The foregoing and additional features and characteristics of the present invention will become more apparent from the following detailed description considered with reference to the accompanying s in which like reference numerals designate like elements and wherein.

DETAILED DESCRIPTION OF THE INVENTION

Figure 1:
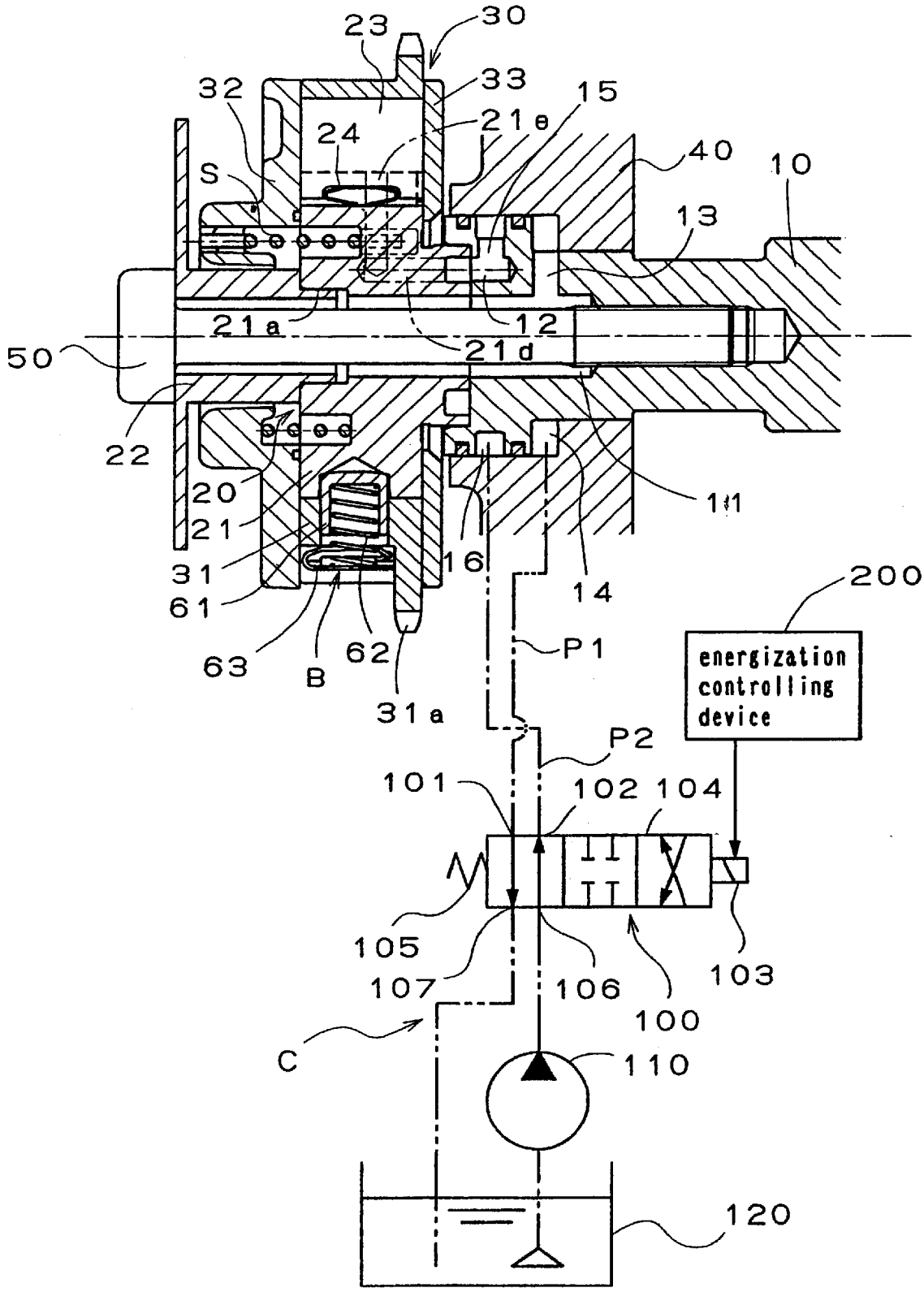
FIG. 1 is a schematic view of a variable valve timing system according to the present invention.

An embodiment of a variable valve timing system for an internal combustion engine in accordance with the present invention is described below with reference to FIGS. 1–7. Referring to FIGS. 1–7, the variable valve timing system includes a rotor member 20 assembled as one unit with the axial end of a camshaft 10 and a housing member 30 supported by the rotor member 20 and rotatable within a predetermined range. The variable valve timing system also includes a torsion spring S disposed between the housing member 30 and the rotor member 20, a first and a second stopper mechanisms A1, A2 for restricting the most retarded angle phase (i.e., an initial phase) and the most advanced angle phase of the housing member 30 and the rotor member 20 respectively, and a lock mechanism B for restricting relative rotation of the housing member 30 and the rotor member 20 at the most retarded angle phase. The variable valve timing system further includes a hydraulic pressure circuit C for controlling supply and discharge of the operation fluid to the lock mechanism B as well as for controlling supply and discharge of the operation fluid to an advanced angle chamber R1 and a retarded angle chamber R2.

The camshaft 10 having a known cam profile (not shown) for controlling the opening and closing of an intake valve (not shown) is rotatably supported by a cylinder head 40 of the combustion engine. The camshaft 10 includes an advanced angle passage 11 and a retarded angle passage 12 extended in axial direction of the camshaft 10. The advanced angle passage 11 is connected to a first connecting port 101 of a hydraulic pressure controlling valve 100 via a first passage 13 formed in radial direction, a first annular passage 14, and a first connecting passage P1. The retarded angle passage 12 is connected to a second connecting port 102 of the hydraulic pressure controlling valve 100 via a second passage 15 formed in radial direction, a second annular passage 16, and a second connecting passage P2. The first and second passages 13, 15 formed in radial direction and the second annular passage 16 are formed on the cam shaft 10. The first annular passage 14 is formed between the camshaft 10 and a stepped portion of the cylinder head 40.

The rotor member 20 includes a main rotor 21 and a front rotor 22 having a cylindrical shape with stepped portion assembled as one unit on the front (i.e., left side of FIG. 1) of the main rotor 21. The rotor member 20 is attached to the front end of the camshaft 10 as one unit by a bolt 50. The central inner bores of the main rotor 21 and the front rotor 22 whose front end is closed by a head portion of the bolt 50 communicates with the advanced angle passage 11 provided on the camshaft 10.

The main rotor 21 includes an inner bore 21*a* coaxially assembled with the front rotor 22 and four vane grooves 21*b* for receiving four vanes 23 respectively and a spring 24 for biasing the vanes 23 in radially outward direction The vanes 23 are assembled in the vane grooves 21*b* respectively and extended in radially outward direction so as to form the advanced angle chambers R1 and the retarded angle chambers R2 respectively in the housing member 30. The main rotor 21 includes four third passages 21*c* in radial direction which are in communication with the advanced angle passage 11 at the radial inner end via the central inner bores and in communication with the advanced angle chamber R1 at the radial outer end. The main rotor 21 also includes four passages 21*d* in axial direction which are in communication with the retarded angle passage 12. The main rotor 21 further includes four fourth passages 21*e* in radial direction which are in communication with the respective passages 21*d* at the inner end in radial direction, and in communication with the retarded angle chamber R2 at the outer end in radial direction.

The housing member 30 includes a housing body 31, a front plate 32, a rear thin plate 33, and five bolts 34 (shown in FIG. 2) connecting the housing member as one unit. The housing body 31 is disposed with a sprocket 31*a* on the outer rear periphery as one unit. The sprocket 31*a* is connected to the crankshaft (not shown) of the combustion engine via a timing chain (not shown) and rotates clockwise by the driving force transmitted from the crankshaft.

The housing body 31 (projecting in radially inward direction rotatably supports the main rotor 21 by its respective radial inner ends of four shoe portions 31*b*). The opposing end face of the front plate 32 and the rear thin plate 33 slidably contact the axial end face of the main rotor 21 and the axial end face of the respective vanes 23.

The housing body 31 has a lug 31*c* (shown as solid line in FIG. 2) structuring the first stopper mechanism A1 for defining the most retarded angle phase (i.e., initial phase) with the vanes 23 and a lug 31*d* (shown as imaginary line in FIG. 2) structuring the second stopper mechanism A2 for restricting the most advanced angle phase with the vanes 28. The housing body 31 is also provided with an attaching bore 31*e* for receiving a lock pin 61, a lock spring 62, and a retainer 63 structuring the lock mechanism B. The attaching bore 31*e* penetrates into the housing body 31 in radial direction and can accommodate the lock pin 62 retractable in radially outward direction.

Figure 2:
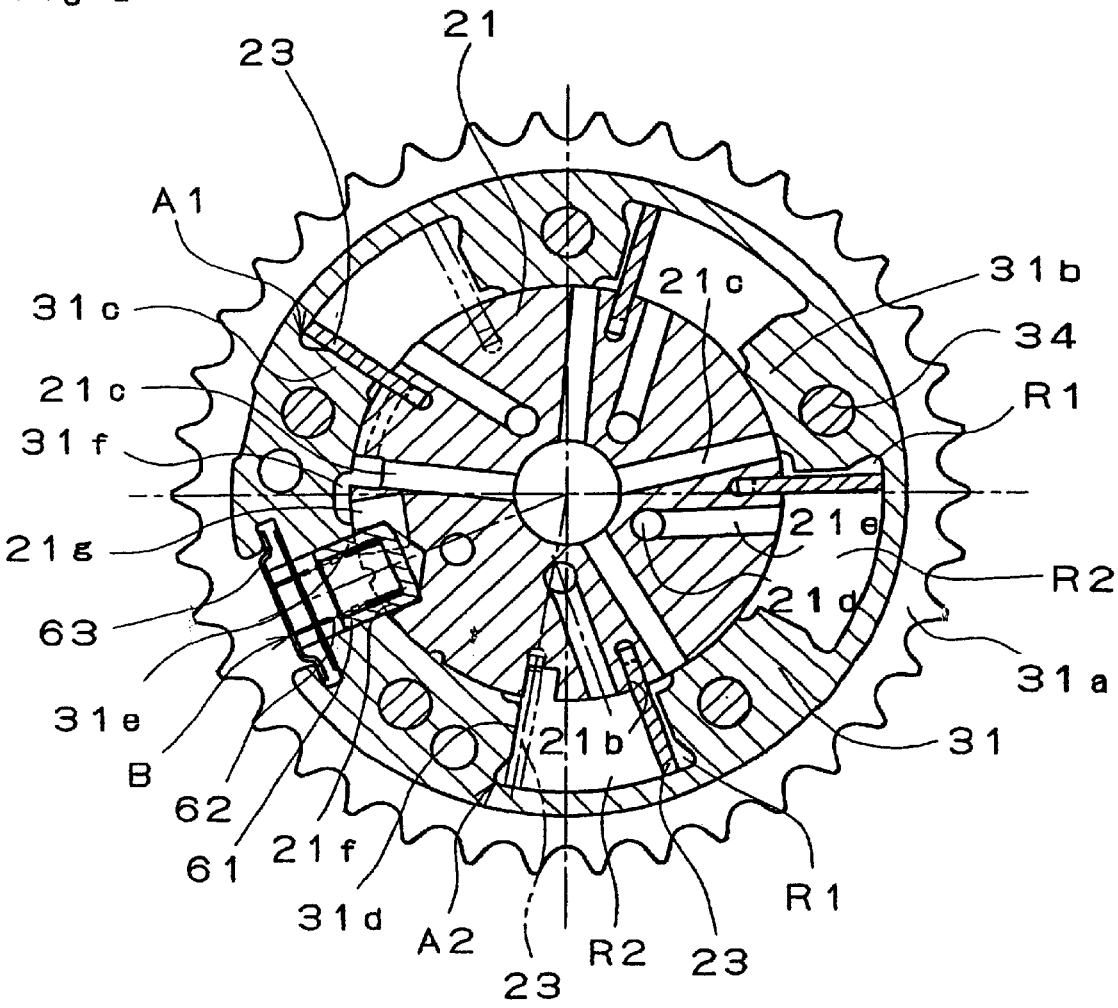
FIG. 2 is a cross sectional view of FIG. 1 taken on line.

The lock pin 61 is formed in cylindrical shape with a bottom at one end. The radial inner tip portion of the lock pin 61 is detachably supported by a lock hole 21*f* formed on the main rotor 21. By supplying the operation fluid to the lock hole 21*f*, the lock pin 61 moves in radially outward direction by overcoming the biasing force (predetermined as a small value) of the lock spring 62 so that the lock spring 62 is retracted and accommodated in the attaching bore 31*e*. As shown in FIG. 2, the lock hole 21*f* communicates with the passage 21*c* in radial direction. And the lock hole 21*f* is provided on the main rotor 21 via a first passage 21*g* in peripheral direction on the outer peripheral portion of the main rotor 21 and via a second passage 31*f* in peripheral direction on the inner peripheral portion of the housing body 31.

The torsion spring S disposed between the housing member 30 and the rotor member 20 rotates the rotor member 20 towards the advanced angle side relative to the housing member 30. The biasing force of the torsion spring S is predetermined to be the extent of value for canceling the biasing force (i.e., derived from the spring biasing the intake valve in the closing direction) for the camshaft 10 and the rotor member 20 rotating towards the retarded angle side. Thus, good response is obtained when the rotor member 20 rotates relatively to the housing member 30 to the advanced angle.

The hydraulic pressure controlling valve 100 shown in FIG. 1 forms the hydraulic pressure circuit C with an oil pump 110 actuated by the combustion engine and an oil reservoir 120 of the combustion engine. A spool 104 of the hydraulic pressure controlling valve 100 is moved in the left direction as shown in FIG. 1 against the force of a spring 105 by the energization of a solenoid 103 when an output signal is received from an energization controlling device 200. By a varying duty value, such as the current value supplied to the solenoid 103, the variable valve timing system operates within the energization range from ① to ⑤ in FIG. 7. The energization controlling device 200 controls the output (i.e., duty value) in accordance with the operation condition of the internal combustion by either a predetermined controlling pattern and or a signal from any one of the sensors for detecting crank angle, cam angle, throttle opening degree, engine rpm, temperature of the engine cooling water, and vehicle speed.

Figure 3:
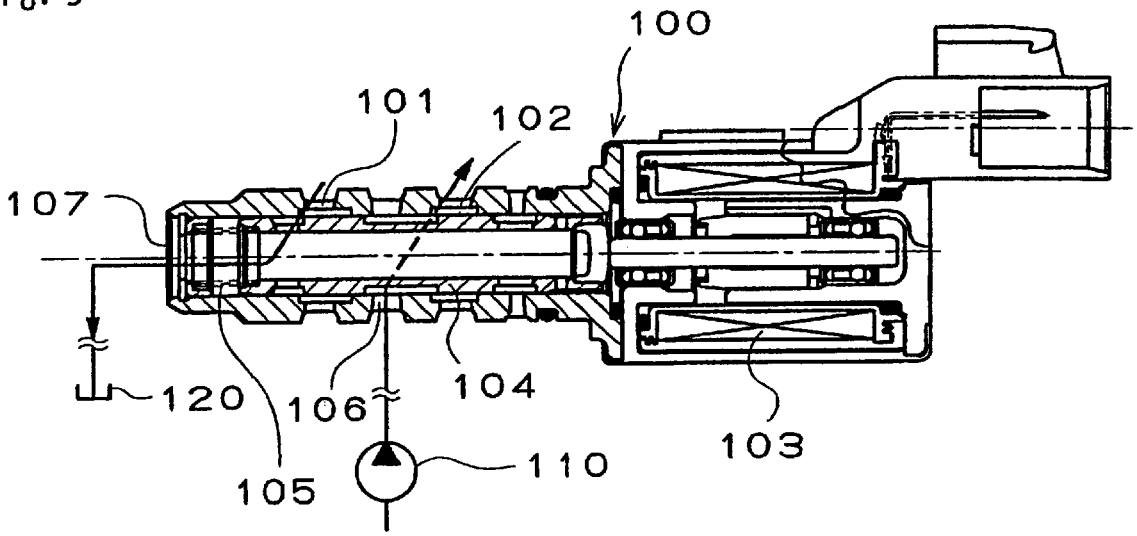
FIG. 3 is a cross-sectional view of a hydraulic pressure controlling valve under a first energization condition.

When the hydraulic pressure controlling valve 100 is operated under a first energization range (i.e., ① of FIG. 7), as shown in FIG. 3, the communication between a supply port 106 connected to an outlet opening of the oil pump 110 so that the second connecting port is established, and the communication between the first connecting port 101 and a discharge port 107 connected to the oil reservoir 120 is established. Thus, the operation fluid is supplied from the supply port 106 to the second connecting port 102 as well as discharged from the first connecting port 101 to the discharge port 107. Accordingly, the operation fluid is supplied from the oil pump 110 to the retarded angle passage 12 and the operation fluid is discharged from the advanced angle passage 11 to the oil reservoir 120. A part of the operation fluid supplied from the oil pump 110 to the retarded angle passage 12 leaks to the oil reservoir 120 via gap of each member (e.g., the gap between the relatively rotating rotor member 20 and the housing member 30).

When the hydraulic pressure controlling valve 100 is operated under a second energization range (i.e., ② of FIG.

Figure 4:
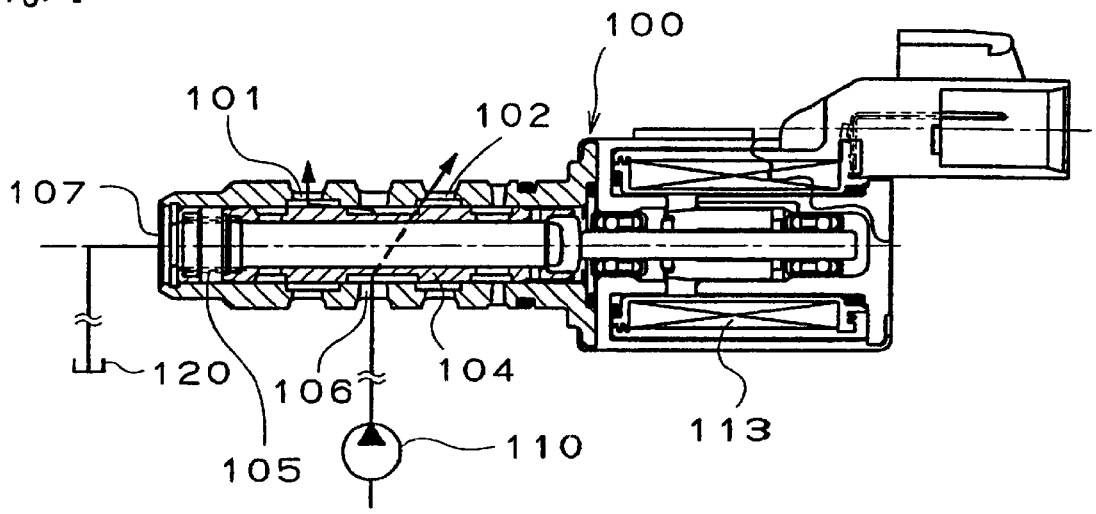
FIG. 4 is a cross-sectional view of the hydraulic pressure controlling valve shown in FIG. 1 under a second energization condition.

7), as shown in FIG. 4, the supply port 106 communicates with the second connecting port 102 and. the communication between the first connecting port 101 and the discharge port 107 is blocked. The operation fluid is supplied from the supply port 106 to the second connecting port 102 via a passage throttled due to the movement of the spool 104. A small amount of the operation fluid is supplied from the supply port 106 to the first connecting port 101 via the outer peripheral gap of the spool 104. Accordingly, the operation fluid is supplied from the oil pump 110 to the retarded angle passage 12 and to the advanced angle passage 11. A part of the operation fluid supplied from the oil pump 110 to the retarded angle passage 12 and the advanced angle passage 11 leaks to the oil reservoir 120 via the gap of each member (e.g., the gap between the relatively rotating rot member 20 and the housing member 30).

When the hydraulic pressure controlling valve 100 is operated under a third energization range (i.e., ③ of FIG. 7), the communication between the supply port 106 and the first and the second connecting ports 101, 102 is blocked as well as the communication between the discharge port 107 and the first and the second connecting ports 101, 102 is blocked (not shown). Thus, small amount of the operation fluid is supplied from the supply port 106 to the first and the second connecting ports 101, 102 respectively via the outer peripheral gap of the spool 104. Accordingly, the operation fluid is supplied from the oil pump 110 to the retarded angle passage 12 and to the advanced angle passage 11. A part of the operation fluid supplied from the oil pump 110 to the retarded angle passage 12 and to the advanced angle passage 11 leaks to the oil reservoir 120 via a gap between the members (e.g., the gap between the relatively rotating rotor member 20 and the housing member 30).

Figure 5:
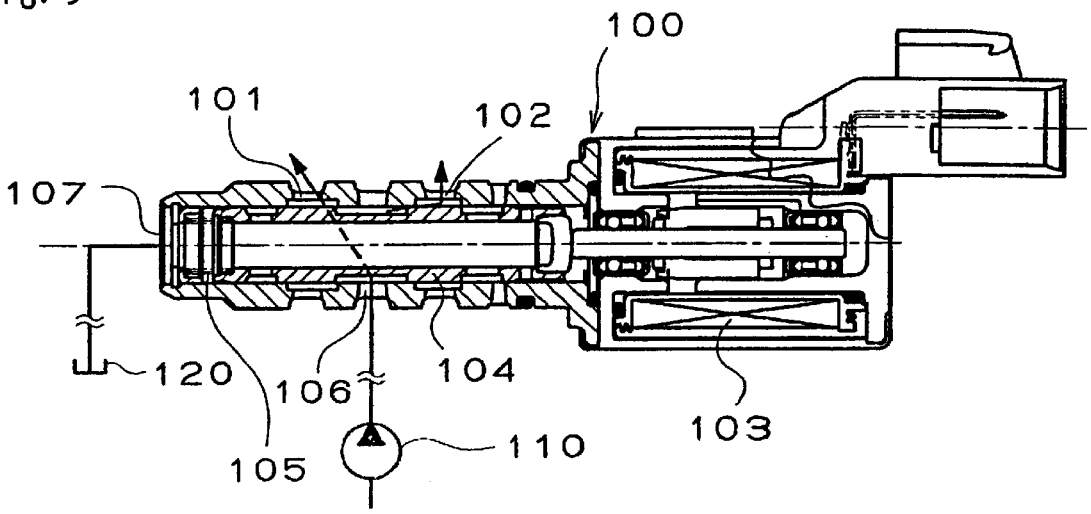
FIG. 5 is a cross-sectional view of the hydraulic pressure controlling valve shown in FIG. 1 under a fourth energization condition.

When the hydraulic pressure controlling valve 100 is operated under a fourth energizing range (i.e., ④ of FIG. 7), as shown in FIG. 5, the supply port 106 communicates with the first connecting port 101 and the communication between the second connecting port 102 and the discharge port 107 is blocked. Thus, the operation fluid is supplied from the supply port 106 to the first connecting port 101 via a passage throttled due to the movement of the spool 104 and small amount of the operation fluid is supplied from the supply port 106 to the second connecting port 102 via the outer peripheral gap of the spool 104. Accordingly, the operation fluid is supplied from the oil pump 110 to the retarded angle passage 12 and to the advanced angle passage 11. A portion of the operation fluid supplied from the oil pump 110 to the retarded angle passage 12 and to the advanced angle passage 11 leaks to the oil reservoir 120 via the gap between the members (e.g., the gap between the relatively rotating rotor member 20 and the housing member 30). 28

Figure 6:
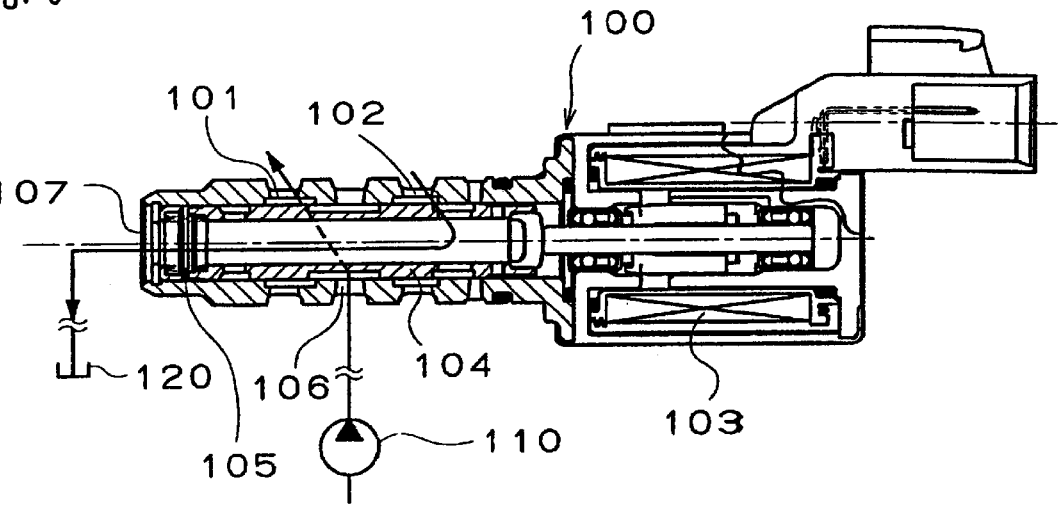
FIG. 6 is a cross-sectional view of the hydraulic pressure controlling valve shown in FIG. 1 under a fifth energization condition.

When the hydraulic pressure controlling valve 100 is operated under a fifth energization range (i.e., ⑤ of FIG. 7), as shown in FIG. 6, the supply port 106 communicates with the first connecting port 101 and the second connecting port 102 communicates with the discharge port 107. Thus, the operation fluid is supplied from the supply port 106 to the first connecting port 101 and is discharged from the second connecting port 102 to the discharge port 107. Accordingly, the operation fluid is supplied from the oil pump 110 to the advanced angle passage 11, and the operation fluid is discharged from the retarded angle passage 12 to the oil reservoir 120. A portion of the operation fluid supplied from the oil pump 110 to the advanced angle passage 11 leaks to the oil reservoir 120 via the gap between the members (e.g., the gap between the relatively rotating rotor member 20 and the housing member 30).

Figure 7:
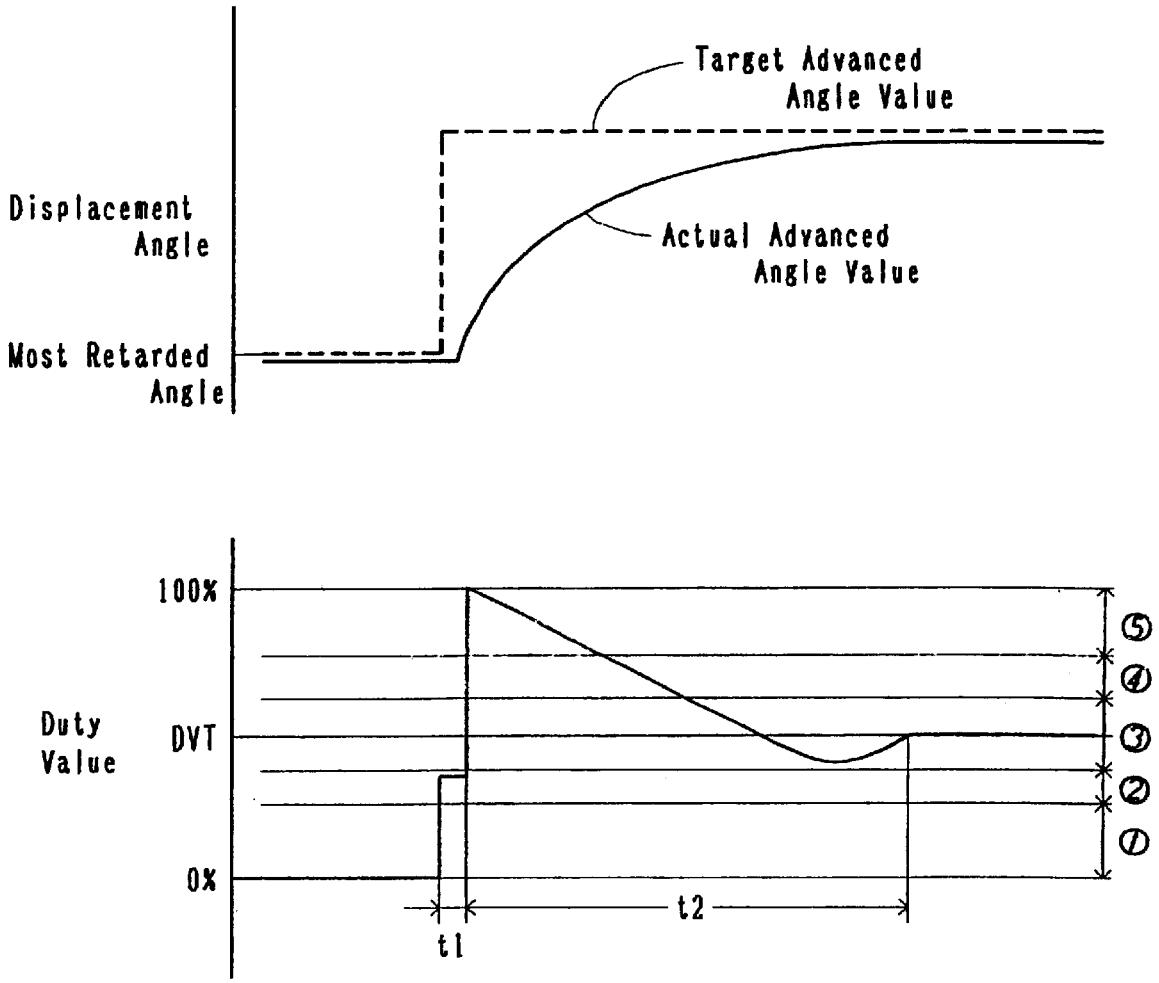
FIG. 7 is a diagram illustrating the operation pattern during the phase shift from the initial phase to the target advanced angle value.

In one embodiment of the variable valve timing system of the present invention, when the phase is varied from the initial phase to the target advanced angle value as shown in FIG. 2, the energization of the hydraulic pressure controlling valve 100 to the solenoid 103 by the energization controlling device 200 is controlled according to a predetermined control pattern shown in FIG. 7. The hydraulic pressure control condition of the hydraulic pressure circuit C is predetermined to vary from the initial hydraulic pressure control condition (hereinafter "a first hydraulic pressure control condition"; i.e., the condition the hydraulic pressure controlling valve 10 is operated under the first energization range shown in FIG. 3, when the duty value corresponds to 0 percent, the rotor is maintained at the initial phase, and relative rotation is locked by the lock mechanism) to the transitional hydraulic pressure control condition (hereinafter "a second hydraulic pressure control condition") in which the hydraulic pressure controlling valve 100 is operated under the second energization range as shown in FIG. 4 for a predetermined time t1 (i.e., time approximately several milli seconds), and then to the hydraulic pressure control condition in which the phase is varied to the target angle value (the phase shiftable hydraulic pressure control condition, hereinafter called "a third hydraulic pressure control condition") in which the hydraulic pressure controlling valve 100 is operated under the range from the fifth to the third energization range.

Under the first hydraulic pressure control condition, the operation fluid is supplied from the oil pump 110 to the retarded angle passage 12, and is discharged from the advanced angle passage 11 to the oil reservoir 120. Thus, the rotor member 20 is maintained at the initial phase relative to the housing member 30 by the hydraulic pressure of the operation fluid supplied to the retarded angle chamber R2 via the retarded angle passage 12. The lock pin 61 of the lock mechanism B is received in the lock hole 21*f* by the lock spring 62.

Under the second hydraulic pressure control condition the operation fluid is supplied from the oil pump 110 to the advanced angle passage 11 and to the retarded angle passage 12. Thus, the hydraulic pressure in the advanced angle chamber R1 and the lock hole 21*f* is gradually increased by the operation fluid supplied to the advanced angle chamber R1 and to the lock hole 21*f* via the advanced angle passage 11 while the hydraulic pressure in the retarded angle chamber R2 being maintained at high level by the operation fluid supplied to the retarded angle chamber R2 via the retarded angle passage 12.

The condition in which the rotational torque towards the retarded angle side generated by the hydraulic pressure in the retarded angle chamber R2 is equal to or greater than the sum of the rotational torque towards the advanced angle side generated by the hydraulic pressure in the advanced angle chamber R1 and the rotational torque towards the advanced angle side by the torsion spring S. The condition is maintained during a time equal to or longer than the predetermined time t1. In other words, the rotational force of the torsion spring S is canceled by the hydraulic pressure of the operation fluid supplied from the hydraulic pressure circuit C to the advanced angle chamber R1 and to the retarded angle chamber R2. Thus, the rotor member 20 is supported at the initial phase relative to the housing member 30. The lock pin 61 of the lock mechanism B is also moved against spring force of the lock spring 62 which is to be retracted by the operation fluid supplied to the lock hole 21*f* via the advanced angle passage 11.

Under the third hydraulic pressure control condition in which the phase is varied to the target advanced angle value, the energization to the solenoid 103 is varied from the fifth energization range ⑤ to the third energization range ③ via the fourth energization range during a predetermined time t2 (i.e., time approximately 200 milli seconds) as shown in FIG. 7. Thus, the actual advanced angle value is gradually varied from the retarded angle to the target advanced angle value as shown in FIG. 7.

According to another embodiment of the variable valve timing system of the present invention, the relative rotation between the rotor member 20 and housing member 30 is adjusted and maintained at a desired phase within the range from the most retarded angle phase (i.e., the phase in which the volume of the advanced angle chamber R1 is minimum and the volume of the retarded angle chamber R2 is maximum) to the most advanced angle phase (i.e., the phase in which the volume of the advanced angle chamber R1 is maximum and the volume of the retarded angle chamber R2 is minimum). Thus, the valve timing of the intake valve during the drive of the combustion engine is appropriately adjusted between the operation at the most retarded angle control condition and the most advanced angle control condition.

In another embodiment of the variable valve timing system of the present invention, during the phase being varied from the initial phase (the most retarded angle phase) to the target advanced angle value, the hydraulic pressure control condition of the hydraulic pressure circuit C is varied from the first hydraulic pressure control condition to the second hydraulic pressure control condition, and then to the third hydraulic pressure control condition. Thus, the lock mechanism B is gradually unlocked by the operation fluid supplied from the hydraulic pressure circuit C to the lock hole 21*f* while the housing member 30 and the rotor member 20 are maintained at the initial phase by the operation of the stopper mechanism A1 and the control of the hydraulic pressure circuit C (i.e., the condition in which the rotational force of the torsion spring S is canceled by the hydraulic pressure of the operation fluid supplied from the hydraulic pressure circuit C to the advanced angle chamber R1 and to the retarded angle chamber R2) during the predetermined time t1.

When the housing member 30 and the rotor member 20 are maintained at the initial phase by the operation of the stopper mechanism A1 and the control of the hydraulic pressure circuit C, the lock pin 61 of the lock mechanism B moves between the locked position and the unlocked position with almost no sliding resistance. Accordingly, the lock pin 61 of the lock mechanism B promptly moves from the locked position to the unlocked position in the predetermined time t1 so as to be accurately retracted without being caught between the rotor member 20 and the housing member 30.

The predetermined time t1 is shorter than a time required for the lock pin 61 of the lock mechanism B moved from the locked position to the unlocked position (i.e., approximately 10 milli seconds) during the predetermined time t1 by the hydraulic pressure of the operation fluid supplied from the hydraulic pressure circuit C to the lock hole 21*f* (approximately milli second -2 milli seconds).

In this case, although the lock pin 61 of the lock mechanism B is almost caught between the rotor member 20 and the housing member 30 by the rotational force of the torsion spring S, the lock pin 61 has started moving towards the unlocked position. Moreover, since the appropriate clearance is provided between the lock hole 21*f* and the lock pin 61, the lock pin 61 retracts to the unlocked position before being caught between the rotor member 20 and the housing member 30.

As forgoing, according to one embodiment of the variable valve timing system of the present invention, the housing member 30 rotates as one unit with the crankshaft and the rotor member 20 rotates as one unit with the camshaft 10. In another embodiment, the housing member rotates in one unit with the camshaft and the rotor member rotates as one unit with the crankshaft. Alternatively, the vane is formed as one unit with the rotor body.

Although the present invention is applied to a variable valve timing system mounted on a camshaft for controlling the opening and closing of an intake valve, the present invention is applied to a variable valve timing system mounted on the camshaft for controlling the opening and closing of an exhaust valve, in which the most advanced angle phase of the rotor member relative to the housing member defines the initial phase.

In one embodiment of the variable valve timing system of the present invention, the second hydraulic pressure condition is obtained by operating the hydraulic pressure control valve 100 under the second energization range for a predetermined time t1 during the phase shift from the initial phase to the target advanced angle value. Alternatively, the second hydraulic pressure control condition is obtained by operating the hydraulic pressure controlling valve 100 under the fourth energization range and under the third energization range for the predetermined time t1. In those cases, the operation fluid is supplied from the pump 110 to the retarded angle passage 12 and to the advanced angle passage 11.

In another embodiment of the variable valve timing system of the present invention (regardless of the temperature of the operation fluid flowing in the hydraulic pressure circuit C the same operation is obtained). The variable valve timing of the present invention is applied to adjust the predetermined time t1 (shown in FIG. 7) of the control pattern to the appropriate value, including zero, in accordance with the temperature of the operation fluid by directly or indirectly detecting the temperature of the operation fluid flowing in the hydraulic pressure circuit C. It is preferred to set the predetermined time t1 as short as possible because the predetermined time t1 prolongs the total time for phase shift from the initial phase to the target advanced angle value.

The principles, preferred embodiments and modes of operation of the present invention have been described in the foregoing specification. However, the invention which is intended to be protected is not limited to the particular embodiments disclosed. The embodiments described herein are illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A variable valve timing system for advancing and retarding a valve timing of intake and exhaust valves of a combustion engine, the system being programmed to control a hydraulic pressure control condition of a hydraulic pressure circuit in the system to shift from an initial hydraulic pressure control condition in which a rotor is maintained at an initial volume and locked by a lock mechanism to a volume shiftable hydraulic pressure control condition in which a volume of an advanced angle chamber is varied to reach a target advanced angle value via a transitional hydraulic pressure condition in which the rotor is maintained at the initial volume and the lock mechanism is released, wherein the hydraulic pressure supplied to the lock mechanism and in the advanced angle chamber is controlled to be gradually increased while the hydraulic pressure in a retarded angle chamber is maintained at high level during the transitional hydraulic pressure control condition.

2. The variable valve timing system according to claim 1, wherein a rotational torque towards a retarded angle side generated by the hydraulic pressure in the retarded angle chamber is controlled to be either equal to or greater than the sum of a rotational torque towards an advanced angle side generated by the hydraulic pressure in the advanced angle chamber and a rotational torque towards the advanced angle side generated by a torsion spring.

3. The variable valve timing system according to claim 2, wherein the system is programmed to control the operation fluid to be supplied to the retarded angle chamber and the advanced angle chamber during the transitional hydraulic pressure control condition.

4. The variable valve timing system according to claim 2, wherein said towards an advanced angle side is in a clockwise direction relatively to an axis of the relative rotation between the rotor member and the housing member, and said towards a retarded angle side is in a counter-clockwise direction relatively to the axis of the relative rotation.

5. A variable valve timing system for advancing and retarding a valve timing of intake and exhaust valves of a combustion engine, the system being programmed to control a hydraulic pressure control condition of a hydraulic pressure circuit in the system to shift from an initial hydraulic pressure control condition in which a rotor is maintained at an initial phase and locked by a lock mechanism to a phase shiftable hydraulic pressure control condition in which a volume of a retarded angle chamber is varied to reach a target retarded angle value via a transitional hydraulic pressure condition in which the rotor is maintained at the initial phase and the lock mechanism is released, wherein the hydraulic pressure supplied to the lock mechanism and in the retarded angle chamber is controlled to gradually increase while the hydraulic pressure in an advanced angle chamber is maintained at high level during the transitional hydraulic pressure control condition.

6. The variable valve timing system according to claim 5, wherein a rotational torque towards a retarded angle side generated by the hydraulic pressure in the retarded angle chamber is controlled to be either equal to or greater than the sum of a rotational torque towards an advanced angle side generated by the hydraulic pressure in the advanced angle chamber and a rotational torque towards the advanced angle side generated by a torsion spring.

7. The variable valve timing system according to claim 6, wherein the system is programmed to control the operation fluid to be supplied to the retarded angle chamber and the advanced angle chamber during the transitional hydraulic pressure control condition.

8. The variable valve timing system according to claim 6, wherein said towards an advanced angle side is in a clockwise direction relatively to an axis of the relative rotation between the rotor member and the housing member, and said towards a retarded angle side is in a counter-clockwise direction relatively to the axis of the relative rotation.

9. A variable valve timing system, comprising:

a housing member provided in the driving force transmitting system for transmitting the driving force from a crankshaft of a combustion engine to a camshaft for controlling the opening and closing of either one of an intake valve or a exhaust valve of the combustion engine;

a rotor member relatively rotatably mounted into the housing member and forming an advanced angle chamber and a retarded angle chamber at a vane portion in the housing member, said rotor member rotating as one unit with either the camshaft or the crankshaft;

a torsion spring disposed between the housing member and the rotor member rotatably biasing the rotor member relative to the housing member;

a lock mechanism for restricting relative rotation between the housing member and the rotor member at the initial volume of the relative rotation;

a hydraulic pressure circuit for controlling supply and discharge of operation fluid to the advanced angle chamber and the retarded angle chamber and for controlling supply and discharge the operation fluid to the lock mechanism; and an energization controlling device for controlling the hydraulic pressure control condition of the hydraulic pressure circuit when a volume of either the advanced angle chamber or the retarded angle chamber shifts from an initial volume to a target volume, wherein the hydraulic pressure control condition of the hydraulic pressure circuit is shifted from an initial hydraulic pressure control condition in which the volume is maintained at the initial volume and locked by the lock mechanism to a transitional hydraulic pressure control condition in which the volume is maintained at the initial volume and the lock mechanism is released in a predetermined time, and to reach a volume shiftable hydraulic pressure control condition in which the volume is being varied to the target volume, wherein the hydraulic pressure supplied to the lock mechanism and in the advanced angle chamber is gradually increased while the hydraulic pressure in the retarded angle chamber is maintained at high level during the transitional hydraulic pressure control condition.

10. The variable valve timing system according to claim 9, wherein a rotational torque towards a retarded angle side generated by the hydraulic pressure in the retarded angle chamber is either equal to or greater than the sum of a rotational torque towards an advanced angle side generated by the hydraulic pressure in the advanced angle chamber and a rotational torque towards the advanced angle side generated by a torsion spring.

11. The variable valve timing system according to claim 10, wherein said towards an advanced angle side is in a clockwise direction relatively to an axis of the relative rotation between the rotor member and the housing member, and said towards a retarded angle side is in a counter-clockwise direction relatively to the axis of the relative rotation.

12. A variable valve timing system, comprising:

a housing member provided in the driving force transmitting system for transmitting the driving force from a crankshaft of a combustion engine to a camshaft for controlling the opening and closing of either one of an intake valve or a exhaust valve of the combustion engine;

a rotor member relatively rotatably mounted into the housing member and forming an advanced angle chamber and a retarded angle chamber at a vane portion in the housing member, said rotor member rotating as one unit with either the camshaft or the crankshaft;

a torsion spring disposed between the housing member and the rotor member rotatably biasing the rotor member relative to the housing member;

a lock mechanism for restricting relative rotation between the housing member and the rotor member at the initial volume of the relative rotation;

a hydraulic pressure circuit for controlling supply and discharge of operation fluid to the advanced angle chamber and the retarded angle chamber and for controlling supply and discharge the operation fluid to the lock mechanism; and an energization controlling device for controlling the hydraulic pressure control condition of the hydraulic pressure circuit when a volume of either the advanced angle chamber or the retarded angle chamber shifts from an initial volume to a target volume, wherein the hydraulic pressure control condition of the hydraulic pressure circuit is shifted from an initial hydraulic pressure control condition in which the volume is maintained at the initial volume and locked by the lock mechanism to a transitional hydraulic pressure control condition in which the volume is maintained at the initial volume and the lock mechanism is released in a predetermined time, and to reach a volume shiftable hydraulic pressure control condition in which the volume is being varied to the target volume, wherein the hydraulic pressure supplied to the lock mechanism and in the retarded angle chamber is gradually increased while the hydraulic pressure in the advanced angle chamber is maintained at high level during the transitional hydraulic pressure control condition.

13. The variable valve timing system according to claim 12, wherein a rotational torque towards a advanced angle side generated by the hydraulic pressure in an advanced angle chamber is either equal to or greater than the subtract of a rotational torque towards the retarded angle side generated by the hydraulic pressure in the retarded angle chamber and a rotational torque towards the advanced angle side generated by a torsion spring.

14. The variable valve timing system according to claim 13, wherein said towards an advanced angle side is in a clockwise direction relatively to an axis of the relative rotation between the rotor member and the housing member, and said towards a retarded angle side is in a counter-clockwise direction relatively to the axis of the relative rotation.

* * * * *